US009123481B2

(12) United States Patent
Dahl

(10) Patent No.: US 9,123,481 B2
(45) Date of Patent: Sep. 1, 2015

(54) MOUNTING OF SPLITTER PLATES IN THE SWITCH POLE OF A CIRCUIT BREAKER

(71) Applicant: Jörg-Uwe Dahl, Werder (DE)

(72) Inventor: Jörg-Uwe Dahl, Werder (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 195 days.

(21) Appl. No.: 13/780,247

(22) Filed: Feb. 28, 2013

(65) Prior Publication Data

US 2013/0234812 A1 Sep. 12, 2013

(30) Foreign Application Priority Data

Mar. 7, 2012 (DE) ..... 10 2012 203 598

(51) Int. Cl.
*H01H 9/36* (2006.01)
*H01H 9/34* (2006.01)
*H01H 71/02* (2006.01)

(52) U.S. Cl.
CPC ..... *H01H 9/362* (2013.01); *H01H 9/346* (2013.01); *H01H 71/0214* (2013.01)

(58) Field of Classification Search
CPC ..... H01H 73/18; H01H 9/30; H01H 9/345; H01H 9/36; H01H 9/362; H01H 2009/365; H01H 2009/367
USPC ..... 335/201–202
See application file for complete search history.

(56) References Cited

U.S. PATENT DOCUMENTS

| | | | | |
|---|---|---|---|---|
| 4,430,631 | A | 2/1984 | Forsell et al. | |
| 6,288,621 | B1 * | 9/2001 | Rival | 335/201 |
| 6,297,465 | B1 | 10/2001 | Dravis | |
| 2003/0094439 | A1 | 5/2003 | Kling et al. | |
| 2008/0067042 | A1 | 3/2008 | Shea et al. | |
| 2008/0180199 | A1 * | 7/2008 | Claeys et al. | 335/202 |
| 2009/0255906 | A1 | 10/2009 | Rane et al. | |

FOREIGN PATENT DOCUMENTS

| | | | |
|---|---|---|---|
| DE | 19735522 | C1 | 1/1999 |
| DE | 10242310 | A1 | 7/2003 |
| DE | 102008050754 | A1 | 4/2010 |
| EP | 2110831 | A2 | 10/2009 |

OTHER PUBLICATIONS

German Office Action Patent Publication No. 10 2012 203 598.2 Dated Nov. 6, 2012.

* cited by examiner

*Primary Examiner* — Ramon Barrera
(74) *Attorney, Agent, or Firm* — Harness, Dickey & Pierce, P.L.C.

(57) ABSTRACT

An embodiment of the invention relates to a switch pole of a circuit breaker having two pole shells between which are disposed, in the assembled state, at least one switching contact, current-carrying elements and an arc quenching device having an arc runner plate and at least one splitter plate delimiting an arc chute, wherein at least one slot for accommodating the splitter and/or arc runner plate is provided between the pole shells. In at least one embodiment, there is provided inside between the pole shells a functional component having a least one slot spaced apart from the pole shells which is used to accommodate the at least one splitter and/or arc runner plate.

15 Claims, 3 Drawing Sheets

MOUNTING OF SPLITTER PLATES IN THE SWITCH POLE OF A CIRCUIT BREAKER

PRIORITY STATEMENT

The present application hereby claims priority under 35 U.S.C. §119 to German patent application number DE 10 2012 203 598.2 filed Mar. 7, 2012, the entire contents of which are hereby incorporated herein by reference.

FIELD

At least one embodiment of the invention generally relates to the design of the switch pole or pole cassette of a circuit breaker. In this context, at least one embodiment of the invention relates in particular to the mounting of arc runner and splitter plates inside the pole cassette of the circuit breaker.

BACKGROUND

Circuit breakers are special switches that are usually designed for high currents and can carry not only operating currents and small overload currents, but also, in the event of faults, high overload and short circuit currents, maintain these fault currents for a specified time and break them again. A circuit breaker has the task in particular of interrupting the current flowing through the circuit breaker.

The current is generally interrupted by way of a movable, usually pivoted contact element. To open the contact, the movable contact element is moved away from a fixed contact element, one or more arrangements of movable and stationary contact elements possibly being present in a circuit breaker. The unit comprising movable and fixed contact elements is called the switch pole or pole cassette. A switch pole generally has a double-shell housing composed of two shells of at least approximately symmetrical design. During assembly of a switch pole, the components are first installed in the lower shell and finally the upper shell is placed on top like a lid.

In this connection, DE 10 2008 050 754 A1 discloses a generic switch pole. Inside the switch pole a pivoted contact element is provided via which a current can flow from a first contact element fixed in the housing to a second contact element fixed in the housing when the contacts are closed. If such a current becomes excessively high, swiveling of the pivoted contact element is initiated via the slot motor by the magnetic field produced by the current itself so that its contact arms move away from the contact elements fixed in the housing. In addition, an arc is struck which is deflected into an arcing chamber in the switch poles. Said deflection of the arc is assisted by ferromagnetic metal pieces which drive the arc into the arc chutes of the switch pole in the desired manner.

The switch poles of modern circuit breakers are often encapsulated using pole cassettes. Instead of pre-assembled arc chutes, arc chutes consisting of individual splitter plates and arc runners are often installed.

The switch pole described in DE 10 2008 050 754 A1 has arc chutes including individual splitter plates and arc runner plates. The splitter plates are each held at one end in a slot in one half of the switch pole housing and with the other end in a corresponding slot in the second, opposite half of the switch pole housing. Assembly once again takes place by first inserting the components into the lower shell and then placing the upper shell on top like a lid. The slots engage around part of the plates, while the arc chutes of the switch pole are formed by the exposed areas of the plates.

The problem with the known design of pole cassettes/switch poles is often that during assembly, particularly when placing the second pole shell on top, the splitter plates must engage exactly in the slots of the pole shell being applied. Assembly often proves to be difficult, as the slots particularly in duroplastic materials must be manufactured with a certain oversize, which means that the splitter plates tend to tilt when they are inserted in the slots. This makes it difficult to insert the splitter plates into the slots of the pole shell applied from above, which makes the assembly of the pole cassette/switch pole significantly more difficult.

For this reason it is often necessary to hold and guide the plates during assembly in such a way that the pole cassette can be closed without difficulty. In this respect the large number of individual splitter plates and arc runner plates as well as other components forming the current path poses a particular challenge for closing the pole cassette.

SUMMARY

At least one embodiment of the invention is directed to a pole cassette such that, on the one hand, the arc runner and splitter plates are held securely and, on the other, closure of the pole cassette is facilitated. It must be ensured in each case that that the technical solution to be specified allows adequate dimensioning of the arc chutes. In particular, a sufficient arc chute volume and an overall splitter plate surface area of sufficient size must be provided despite the modification made. The technical solution to be specified shall be realized using relatively simple design means and require no complex/costly manufacturing processes.

A circuit breaker pole cassette is disclosed. Advantageous embodiments of the invention are set forth in the dependent claims and will be explained in greater detail in the following description with reference in some cases to the accompanying drawings.

An embodiment of the invention relates to a circuit breaker switch pole having two pole shells between which are disposed, in the assembled state, at least one switching contact, current-carrying elements and an arc quenching device. The arc quenching device has an arc runner and at least one splitter plate which, at least in sections, delimits an arc chute. Additionally provided between the pole shells is at least one slot which is used to accommodate the splitter plate and/or arc runner plate. In at least one embodiment, there is provided, inside between the pole shells, a functional component having at least one slot spaced apart from the pole shells to accommodate the at least one splitter and/or arc runner plate.

BRIEF DESCRIPTION OF THE DRAWINGS

Without limiting the general inventive concept, the invention will now be explained in greater detail on the basis of example embodiments and with reference to the accompanying drawings in which.

DETAILED DESCRIPTION OF THE EXAMPLE EMBODIMENTS

Figure 1:
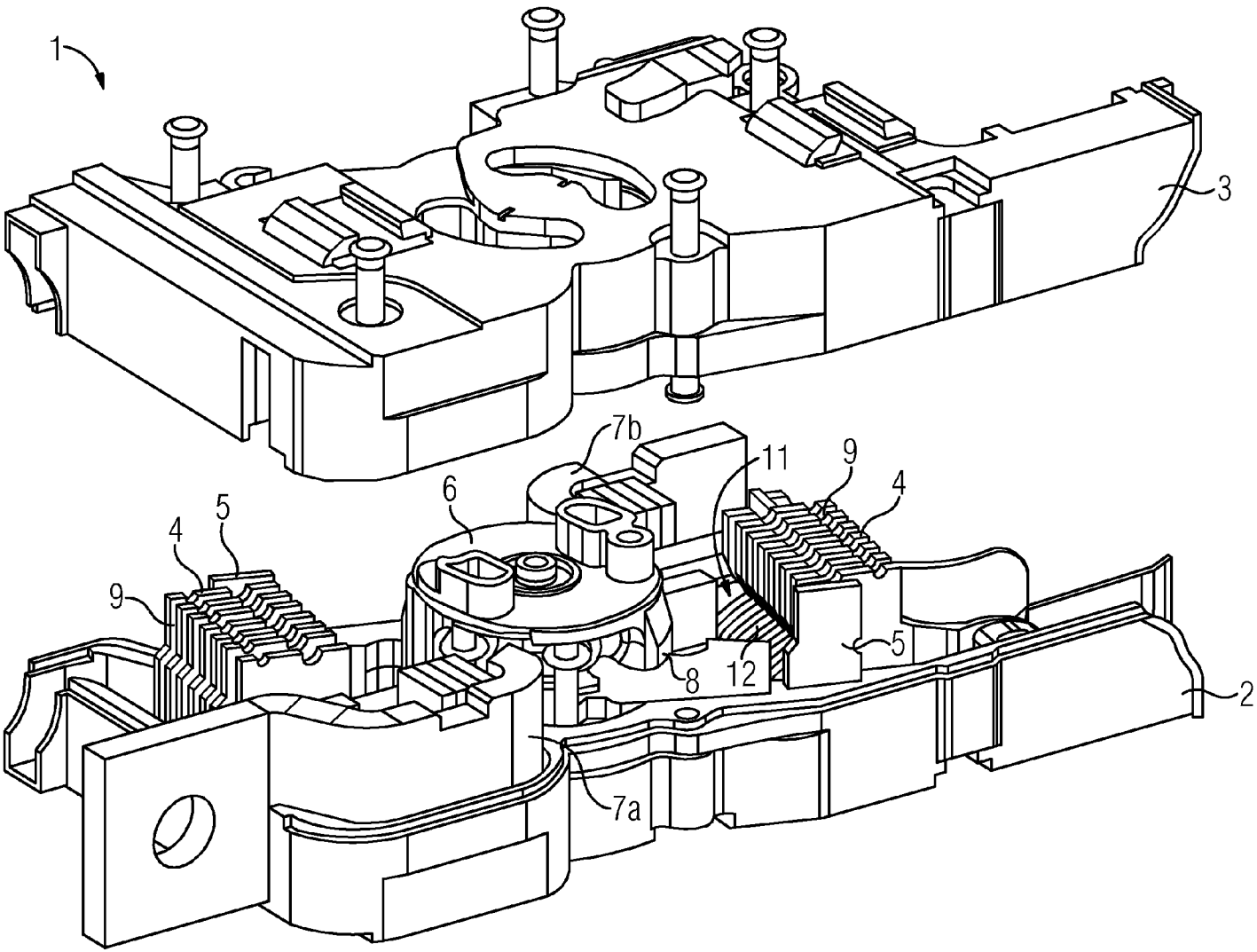
FIG. 1 shows a perspective view of a pole cassette immediately prior to applying the upper pole shell.

Various example embodiments will now be described more fully with reference to the accompanying drawings in which only some example embodiments are shown. Specific structural and functional details disclosed herein are merely representative for purposes of describing example embodiments.

The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

An embodiment of the invention relates to a circuit breaker switch pole having two pole shells between which are disposed, in the assembled state, at least one switching contact, current-carrying elements and an arc quenching device. The arc quenching device has an arc runner and at least one splitter plate which, at least in sections, delimits an arc chute. Additionally provided between the pole shells is at least one slot which is used to accommodate the splitter plate and/or arc runner plate. In at least one embodiment, there is provided, inside between the pole shells, a functional component having at least one slot spaced apart from the pole shells to accommodate the at least one splitter and/or arc runner plate.

According to embodiments of the invention, a functional component is to be understood as meaning a component of the switch pole/pole cassette which assumes a function, e.g. as a cover, in the switch pole. According to at least one embodiment of the invention, it is provided that, in addition to its basic function, the functional component has at least one slot for accommodating at least one splitter plate and/or arc runner plate. As soon as a plate is in the slot of the functional component, it is ensured that the plate is fixed and in particular is prevented from tilting over. The fixing is effected in an area between the pole shells and spaced apart therefrom. However, it is conceivable for the functional component itself to be connected to at least one of the pole shells.

At least one embodiment of the present invention is therefore includes splitter and/or arc runner plates that are retained by slots in a functional component present anyway in the pole cassette. For this purpose the cover of another component, such as a slot motor cover, in particular the cover cap of the slot motor side plates, is provided with slots. Advantageously, the functional component, in particular a cover, has a comb-shaped extension having a plurality of slots in which splitter and/or arc runner plates can be accommodated.

By the insertion of the splitter and/or arc runner plates in slots set into the cover of the slot motor or cover cap of the slot motor side plates, the plates are held in place relative to one another and in their position with respect to the fixed contacts and the movable contact element in the pole cassette during operation. Thus a component that is required anyway, namely a slot motor cover, is used to mount the splitter and/or arc runner plates.

According to a particular further development, the splitter and/or arc runner plates are additionally fixed at their ends in slots located in the pole shells, i.e. on the housing halves of the switch pole. This creates additional guidance which further facilitates pole cassette assembly.

In a specific embodiment of the invention, the pole shells and/or the slot motor cover, in particular the cover cap of the motor side plates, in which the additional slots for holding the splitter and/or arc runner plates are set, are made of a duroplastic material. Alternatively, it is conceivable for the pole shells and in particular the slot motor cover to be made of a thermoplastic material. Preferably a polyamide, in particular PA66, is used for this purpose. If a thermoplastic is used, the slots in the functional component, in particular the slots in the slot motor cover, can be produced as a press-fit in respect of the arc runner and/or splitter plates. In this way optimum guiding of the plates is implemented. According to a particular further development, transition or press fits are provided between the splitter and/or arc runner plates and the slot motor cover and/or between the plates and the slots in the pole shell used to accommodate the individual parts during an assembly process. Preferably, no transition or press fits are provided between the plates and the slots in the pole shell applied as a lid in the final assembly step. Rather, in this area it is advantageous if the plates can be inserted with a small amount of play into the pole shell slots provided for that purpose when closing the pole cassette.

FIG. 1 shows switch pole 1 or more specifically a pole cassette comprising two pole shells 2, 3 that are at least partially mirror images of one another. During assembly of a pole cassette 1, the lower shell 2 is first fitted with the required components, in particular the splitter plates 4 and arc runner plates 5, as well as the current path components, primarily the movable and housing-fixed contact elements 6, 7. When component placement is complete, the pole shell 3 is placed on top as a lid and fastened.

Provided inside the pole cassette 1 are, on the one hand, two housing-fixed contact elements 7*a*, 7*b* and, on the other, a pivoted conducting element 6. The pivoted conducting element 6 has two arms 8 which, in the normal condition, are in contact with the contact elements 7*a*, 7*b*. The arms 8 of the pivoted conducting element 6 are electrically interconnected so that current can flow from one housing-fixed contact element 7*a* to the other housing-fixed contact element 7*b* via the conducting element 6. As soon as the current flowing between the contacts becomes excessively high, the magnetic field generated by the current itself causes the conducting element 6 to swivel so that the arms 8 move away from the associated housing-fixed contact elements 7*a*, 7*b*.

When the contacts open, an arc is first struck which can have temperatures of 5000 to 6000 K. In order to prevent damage, the arc is deflected into arc chutes 9 in which the arc is extinguished. Corresponding arc chutes 9 are disposed on either side of the pivoted conducting element 6 in order to enable arcs produced on both sides to be reliably diverted into the arc chutes 9. In the example embodiment shown, the arc chutes 9 are delimited by individual splitter plates 4 between which the arc chutes 9 are located. In order to enable the arcs to be reliably driven into the arc chutes 9, arc runner plates 5 made of a ferromagnetic material are provided in each case.

Additionally provided on the inside of the pole shells 2, 3 are slots 10 which are used to accommodate and secure the splitter 4 and arc runner plates 5. In addition, as will be explained in further detail below, the splitter 4 and arc runner plates 5 are inventively also retained by slots 11 in a cover 12 of the slot motor, here in the cover caps for the slot motor side plates.

Figure 2:
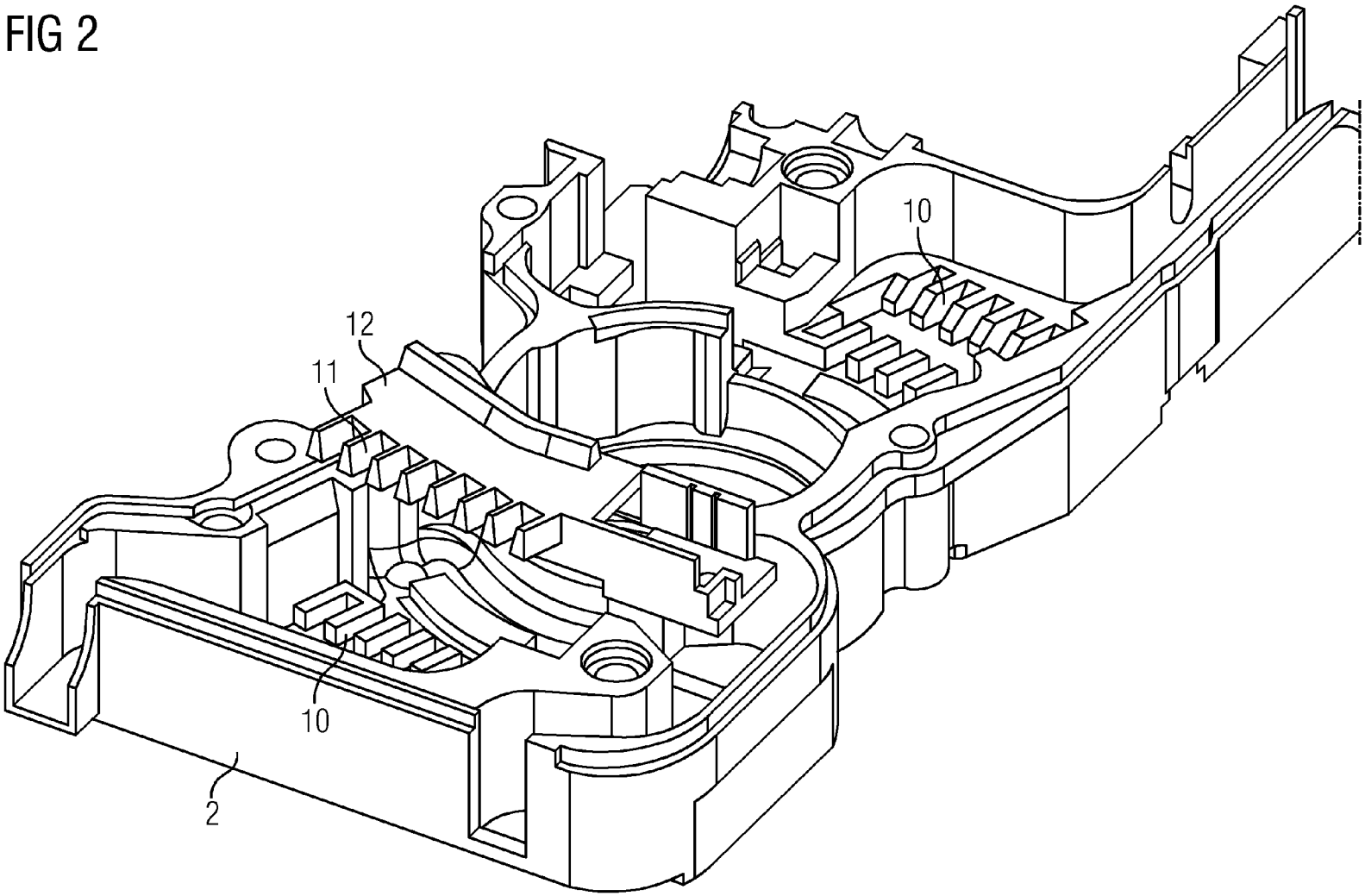
FIG. 2 shows a perspective view of the lower pole shell.

FIG. 2 shows the lower shell 2 of a pole cassette 1 prior to mounting of the splitter 4 and arc runner plates 5 and of the current path components. The pole shell 2 made of duroplastic material has slot-shaped recesses 10 on the inside which are used to accommodate the splitter 4 and arc runner plates 5. The slots 10 are designed such that they have a slight oversize compared to the splitter 4 and arc runner plates 5 and that approximately 10% of the surface of a plate 4, 5 is accommodated in the slot 10 in each case.

Also shown is a cover 12 which is mounted inside the pole cassette 1 and which is used to cover the slot motor side plates but also has comb-shaped extensions with slots 11 which are used to guide the splitter 4 and arc runner plates 5. The cover cap 12 is advantageously made of a thermoplastic material. Thermoplastic material has advantages particularly in respect of producing the slots 11. The slots 11 in the cover 12 for the slot motor side plates are designed so as to provide good guidance of the plates 4, 5 during assembly. This is achieved in that the slots 11 have a sufficient depth and a tightly toleranced width, the width of the slots 11 being designed such that at least a transition fit, but advantageously a press-fit, is created between the splitter 4 and arc runner plates 5 and the edge of the slots 11 located in the cover cap 12. This ensures that the plates 4, 5 are placed securely in position and the lid constituted by the upper pole shell 3 can finally be easily placed onto the lower pole shell 2, in particular onto the contact surface 13 provided for that purpose. In order to facilitate mounting of the upper pole shell 3, the slots for accommodating the plates 4, 5 on the inside of the upper pole shell 3 are designed such that the plates 4, 5 can be inserted into the slots with a slight play.

Figure 3:
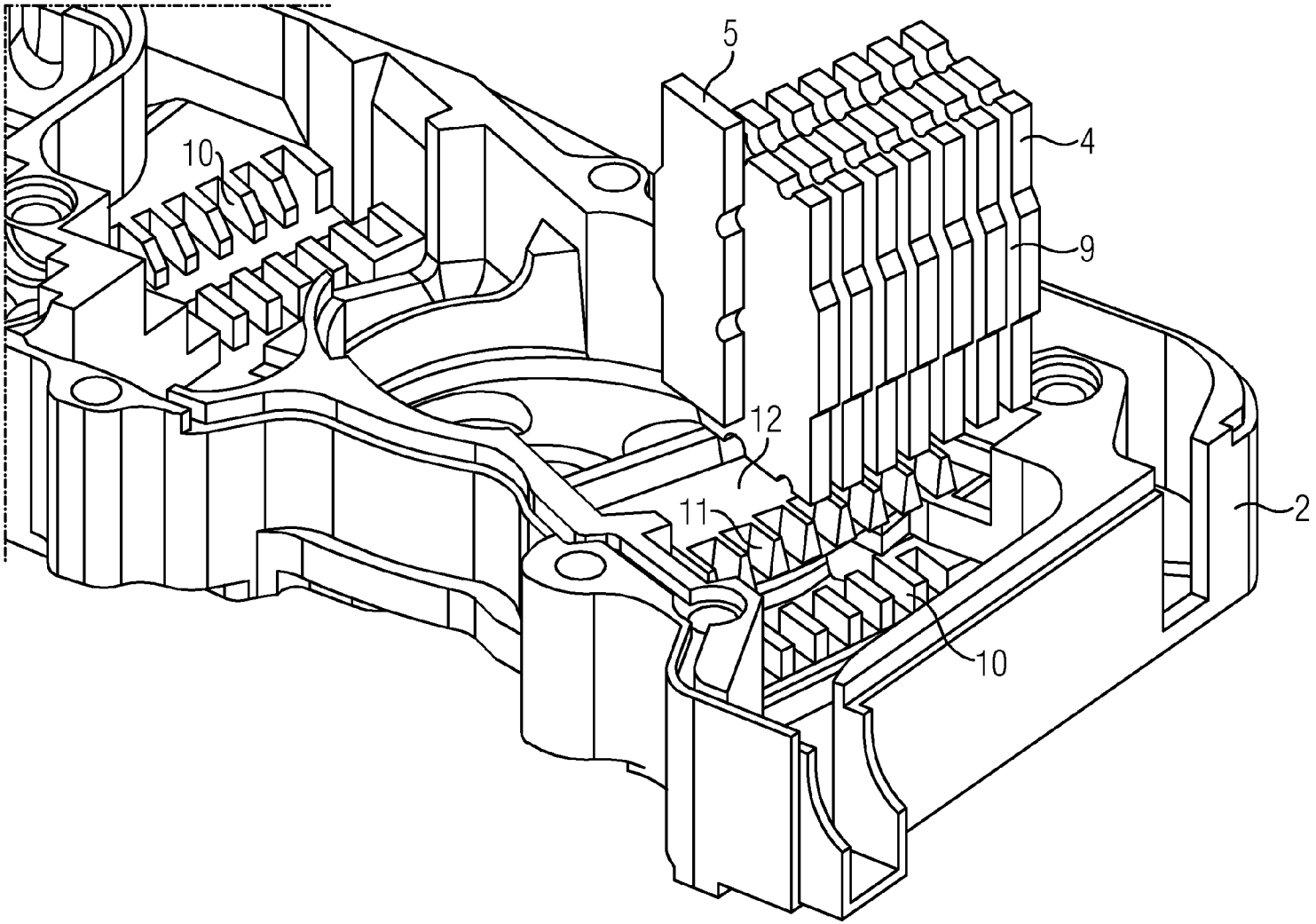
FIG. 3 shows a perspective view of the lower pole shell with arc runner and splitter plates.

FIG. 3 shows the lower pole shell 2 of the pole cassette 1 which in turn has slots 10 on its inner side to accommodate the splitter 4 and arc runner plates 5. Also located inside the lower pole shell 2 is the cover cap 12 for the slot motor side plates. For assembly, the arc runner 5 and the splitter plates 4 can be inserted into the lower pole shell 2 from above, the plates 4, 5 being accommodated, on the one hand, in the lower area by the slots 10 on the inside of the pole shell 2 and, on the other, by the slots 11 in the comb-like extension of the cover cap 12. As there is at least a slight transition fit between the plates 4, 5 and the slots 11 of the cover cap 12, the plates 4, 5 are reliably fixed inside the pole cassette 1, in particular the plates 4, 5 are prevented from tilting over.

With the aid of the inventive solution which enables the arc runner 5 and splitter plates 4 to be fixed using simple devices, in particular by using components present anyway inside the pole cassette 1, the otherwise often difficult individual plate assembly is simplified. As the plates 4, 5 are fixed in their position, in particular as they are prevented from tilting over, the upper pole shell 3 of the pole cassette 1 can be placed on easily. By using the cover cap 12 for the slot motor side plates for additional guidance of the arc runner plates 5 and splitter plates 4, a component with increased functional integration can also be created.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A switch pole of a circuit breaker, comprising:

two pole shells including an upper pole shell and a lower pole shell, at least one switching contact between the two pole shells when the two pole shells are in an assembled state, current-carrying elements, an arc quenching device including an arc runner plate and at least one splitter plate delimiting an arc chute, at least one first slot for accommodating at least one of the at least one splitter plate and the arc runner plate is provided between the pole shells, and a functional component between the two pole shells, the functional component including at least one second slot spaced apart from the at least one first slot such that the at least one second slot is i) parallel to and aligned with the at least one first slot, and ii) located between the two pole shells at a center portion of the switch pole such that the at least one second slot is usable in cooperation with the at least one first slot to accommodate the at least one of the at least one splitter and the arc runner plate.

2. The switch pole of claim 1, wherein the functional component assumes the function of a cover.

3. The switch pole of claim 1, wherein the functional component is a slot motor cover.

4. The switch pole of claim 1, wherein the functional component is a cover cap of a slot motor side plate.

5. The switch pole of claim 1, wherein the functional component includes a comb-shaped extension in which at least one slot is provided for accommodating the at least one of the at least one splitter and the arc runner plate.

6. The switch pole of claim 1, further comprising a transition or press-fit, between the at least one of the at least one splitter and the arc runner plate and the slot of the functional component.

7. The switch pole of claim 1, wherein there is a slight play between the at least one of the at least one splitter and the arc runner plate and the slot of the upper pole shell placed on top as a lid.

8. The switch pole of claim 1, wherein the functional component is made of a thermoplastic material.

9. The switch pole of claim 1, wherein at least one of the lower and the upper pole shell is made of a thermoplastic material.

10. The switch pole of claim 8, wherein the plastic material is a polyamide.

11. The switch pole of claim 8, wherein the plastic material is a polyamide 66 (PA66).

12. The switch pole of claim 1, wherein the at least one second slot covers no more than 8 to 12% of the surface of the splitter or arc runner plate located in the slot.

13. The switch pole of claim 1, wherein the at least one first slot is provided inside at least one of the lower and upper pole shell.

14. The switch pole of claim 2, wherein the functional component is a slot motor cover.

15. The switch pole of claim 9, wherein the plastic material is a polyamide.

* * * * *